US005231824A

United States Patent [19]

Van Dick

[11] Patent Number: 5,231,824

[45] Date of Patent: Aug. 3, 1993

[54] ION BEAM AND ION JET STREAM MOTOR

[76] Inventor: Robert C. Van Dick, P.O. Box 207, Lakemont, Ga. 30552

[21] Appl. No.: 743,271

[22] Filed: Aug. 9, 1991

[51] Int. Cl.[5] ..... H05H 1/00

[52] U.S. Cl. ..... 60/202

[58] Field of Search ..... 60/202, 203.1

[56] References Cited

U.S. PATENT DOCUMENTS

| | | | |
|---|---|---|---|
| 2,765,975 | 10/1956 | Lindenblad | 230/69 |
| 2,809,314 | 10/1957 | Herb | 60/202 |
| 3,187,206 | 6/1965 | Brown | 310/5 |
| 3,226,592 | 12/1965 | Gough et al. | 60/202 |
| 3,267,860 | 8/1966 | Brown | 103/1 |
| 3,308,623 | 3/1967 | Ferrie et al. | 60/203.1 |
| 3,367,114 | 2/1968 | Webb | 60/202 |
| 3,620,018 | 11/1971 | Banks | 60/202 |
| 4,028,579 | 6/1977 | King | 60/202 |
| 4,328,667 | 5/1982 | Valentian et al. | 60/202 |
| 4,577,461 | 3/1986 | Cann | 60/203.1 |
| 4,866,929 | 9/1989 | Knowles et al. | 60/202 |

FOREIGN PATENT DOCUMENTS

| | | | |
|---|---|---|---|
| 1368255 | 6/1964 | France | 60/203.1 |
| 0151573 | 6/1991 | Japan | 60/202 |

OTHER PUBLICATIONS

Scientific American, Mar. 1961, vol. 204, No. 3, pp. 57-67.

*Primary Examiner*—Richard A. Bertsch
*Assistant Examiner*—Howard R. Richman
*Attorney, Agent, or Firm*—Kennedy & Kennedy

[57] ABSTRACT

An ion beam and jet stream motor useful as motive and propulsive forces is formed by generating a collimated ion beam and projecting the collimated ion beam into an electrically charged, tubular electrode. This is done with an ion beam motor having a pointed electrode mounted adjacent an end of a tubular electrode coupled with a high voltage power supply. The generated ion jet stream is useful in controlling or extinguishing flames.

12 Claims, 2 Drawing Sheets

ION BEAM AND ION JET STREAM MOTOR

TECHNICAL FIELD

This invention relates to methods and means for generating ion beams and ion jet streams useful as propulsive forces and to the use of such in controlling flames.

BACKGROUND OF THE INVENTION

Ion generators have long been used in air filters, for the control of static electricity, and even to soothe and calm humans. Though most have been of a static nature and construction, some have employed blowers to circulate ionized air.

SUMMARY OF THE INVENTION

It has now been discovered that ion beams and ion jet streams may be generated that can be employed as a motive and propulsive force. The ion jet stream is generated with an ion beam motor that comprises a pointed electrode mounted adjacent a tubular electrode together with means for applying high voltage, which herein means voltage in excess of one thousand volts (>1 KV), between the electrodes. The two electrodes are spaced apart a distance sufficient to prevent arcing with the pointed electrode mounted adjacent one end of the tubular electrode and preferably slightly outside of it. In operation a thin, laser-like collimated ion beam may be observed to extend from the tip of the needle into the tube. Adjacent the needle tip the ion beam is white but further away it turns to blue. A hissing sound issues from the tube at its inlet end adjacent the needle. In darkness a disc-shaped, light-blue energy field may also be seen formed over the inlet of the tube which field is penetrated centrally by the laser-like collimated ion beam. The diameter of the beam increases slightly after passage through this energy field and also may then be seen to meander and wave about within the tube and to visually terminate therein so that it appears much like a tail. A vortex type ionized jet air stream issues from the outlet end of the tube that is distal to the needle. The jet like stream sustains its vortex flow pattern and remains collimated for a substantial distance.

The method and apparatus may be employed as a motor to drive mechanisms exposed to the ion jet streams, such as impellers, and to propel things to which the ion beam motor is mounted. The method and motor has also been found to be useful in controlling flames. By directing the ion jet stream into a flame, the flame profile may be altered. Indeed, with sufficient stream size and strength, flames may be extinguished by the stream.

DETAILED DESCRIPTION OF THE DRAWING

Figure 1:
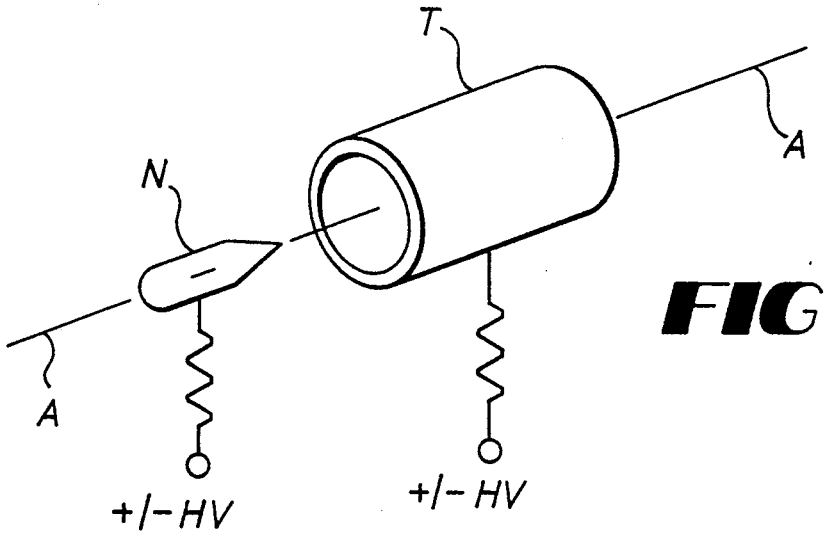
FIG. 1 is a schematic illustration of an ion beam motor embodying principles of the invention in a preferred form which may be employed in practicing methods of the invention.

An ion beam motor that generates an ion jet stream embodying principles of the invention is schematically illustrated in FIG. 1. Here it is seen that an electrically conductive needle N, herein also referred to as a pointed electrode, is shown mounted in air adjacent one open end of an electrically conductive, thin tube T with a cylindrical bore, which tube is herein referred to as a tubular electrode. The point or tip of the needle N is positioned on the axis A of the tube outside of the tube inlet end. The motor also has conventional means for establishing a high voltage (HV) potential difference between the needle and tube, as schematically shown. The needle and tube are spaced apart a distance sufficient to prevent arcing for the level of the high voltage employed.

Experiments have shown that various voltages may be employed in practicing the invention. The most important criteria found in this regard is that a high voltage, i.e. voltage in excess of 1 KV, exists between the needle and tube but not a voltage so great that it produces arcing between the needle and tube. To establish the potential difference between the needle and tube, high voltage with respect to signal ground may be applied only to the needle, or only to the tube, or to both. Various combinations of direct current (dc), alternating current (ac) and pulsed voltages have been found to be workable. However, where high voltage is applied to both electrodes it has been found that such should be of opposite polarity. Preferably, the voltage is dc and of a polarity to generate a beam of cations (positive ions) from about the needle rather than anions (negative ions). The use of ac voltage and pulsed waveforms has been found to produce less ion jet stream velocities from that produced by dc voltages.

On a laboratory basis the pointed electrode may be a thin, electrically conductive needle with a sharp tip and a rounded opposite end. Though larger, ruggedized electrodes may be employed for commercial and industrial applications, they still should have at least one rather sharp point as a rounding off of the point has been found rapidly to degenerate ion stream generation.

The point of the pointed electrode is shown in FIG. 1 to be positioned outside of the tube on the tube axis A. However, it has been found that the point may be mounted at the tube entrance or inlet, and even a little inside of the tube, provided that its spacing from the tube wall is sufficient to prevent arcing for the voltage employed. Also, it has been found that the needle tip may be located off of the axis A and that the needle may be oriented other than coaxially or parallel with axis A.

Figure 3:
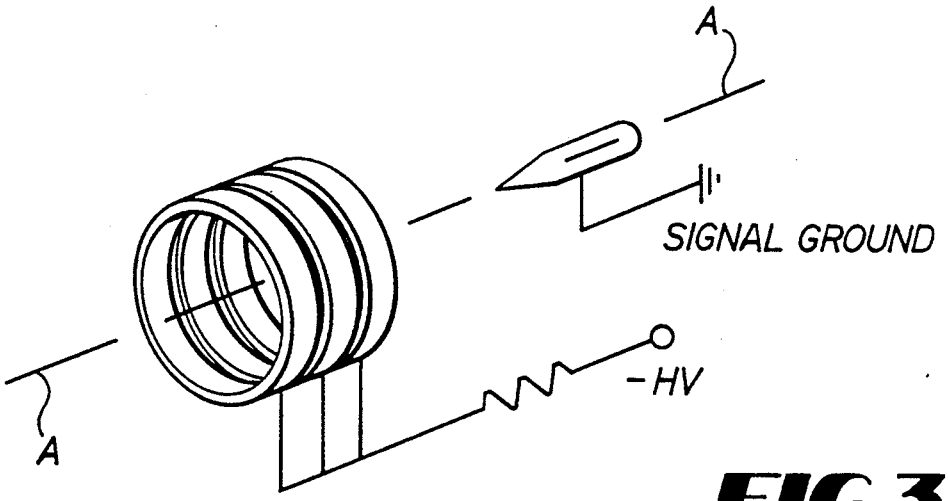
FIG. 3 is a schematic illustration of an ion beam motor embodying principles of the invention in an alternative form.
Figure 4:
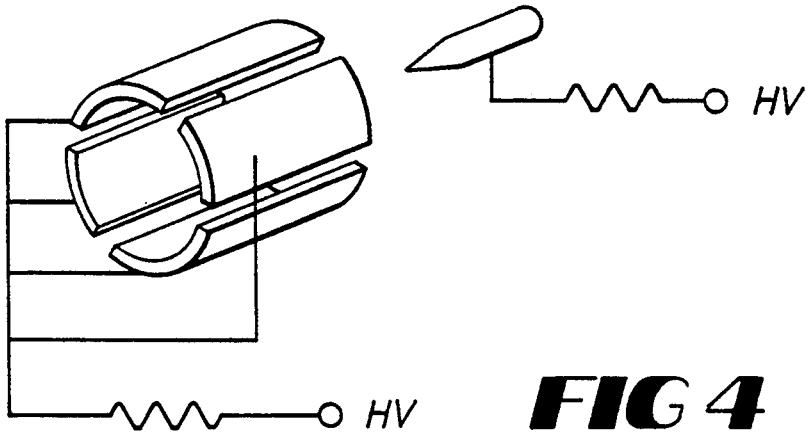
FIG. 4 is a schematic illustration of an ion beam motor embodying principles of the invention in yet another alternative form.

With regard to the tube T, it too may be of various shapes and forms. It may not only have a cylindrical bore but may instead have a rectangular bore. In FIG. 1 the tube is shown to be of short, thin walled, solid construction. However, it has been found that it may be comprised of a series of spaced, electrically connected, conductive rings arrayed in a tubular array, as shown in FIG. 3. Furthermore, it has been found that instead of having axially spaced gaps (FIG. 4), it may have annular gaps so that it is effectively comprised of a set of electrically connected arcuate segments as shown in FIG. 3. Preferably, the tube should have a length of at least one inch for lesser lengths produce lesser collimation of the ion jet stream. However, even a single ring, square or triangle may suffice for the tubular electrode, though such produce poorly defined streams of unsteady and erratic velocities and flow patterns.

Air velocity measurements were made with tubular electrodes of a 15/16 inch inside diameter taken 1.5 inches from the tube outlets. The velocities were found to be 950, 650 and 500 feet per minute respectively for tubes of 2.0, 6.0 and 12.0 inches and then to decrease, substantially linearly, to 400 feet per minute for longer tubes up to a tube of 24 inches length.

Figure 2:
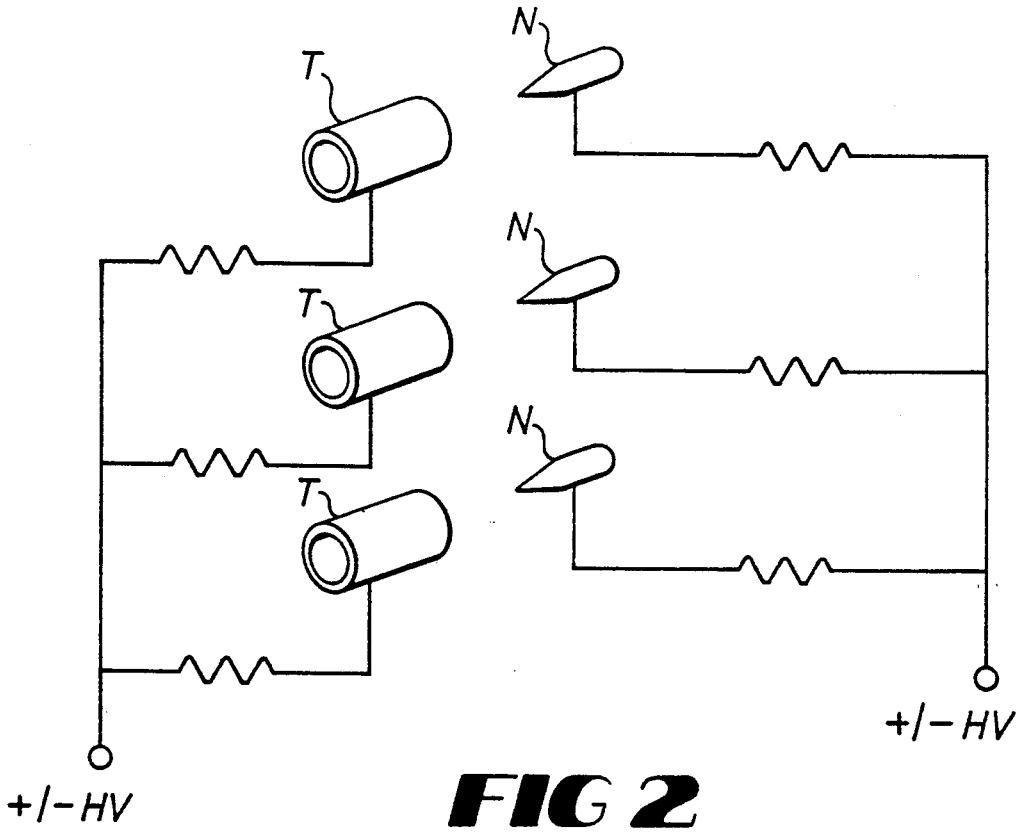
FIG. 2 is a schematic illustration of an ion beam motor embodying principles of the invention in another preferred form which also may be used in practicing methods of the invention.

For the generation of larger and more powerful ion jet streams sets of pointed and tubular electrodes may be ganged together as schematically shown in FIG. 2. Structurally, this may be in the form of a set of electrically insulated conductive tubes mounted side by side in a honeycomb pattern, and a set of pointed electrodes mounted side by side in alignment with the tubes. Alternatively, the pointed electrodes may be made of a single, unitary conductor with multiple points or tips if they are all at zero volts (i.e. signal ground).

Laboratory experiments have been conducted in air with a thin, solid, conductive tube having a one inch outside diameter and a two inch length with the tip of the needle positioned on the tube axis. The results are shown in Table I with a negative, dc voltage with respect to signal ground applied to the tube T, and a positive, dc voltage with respect to signal ground applied to the needle. The spacing between the tube and needle is given in inches as measured along the tube axis. Each resistor, as shown in FIG. 1, was of a 11 megohm value. The velocity of the ion jet stream is given in feet per minute as measured one and a half inches from the tube outlet along the tube axis.

TABLE I

| TUBE −DC KV | NEEDLE +DC KV | Velocity ft./min | Spacing inches |
|---|---|---|---|
| 8 | 0 | 250 | 0 |
| 12 | 0 | 500 | 0 |
| 16 | 0 | 800 | 3/16 |
| 20 | 0 | 900 | 7/16 |
| 8 | 2 | 500 | 0 |
| 12 | 2 | 750 | 1/16 |
| 16 | 2 | 900 | 5/16 |
| 20 | 2 | 950 | 1/2 |
| 8 | 4 | 500 | 0 |
| 12 | 4 | 700 | 3/16 |
| 16 | 4 | 800 | 7/16 |
| 20 | 4 | 1000 | 1/2 |
| 8 | 6 | 650 | 5/16 |
| 12 | 6 | 750 | 1/2 |
| 16 | 6 | 900 | 1/2 |
| 20 | 6 | 600 | 7/8 |
| 8 | 8 | 900 | 3/16 |
| 12 | 8 | 950 | 5/16 |
| 16 | 8 | 850 | 9/16 |
| 20 | 8 | 500 | 1-1/8 |
| 8 | 10 | 1000 | 5/16 |
| 12 | 10 | 950 | 1/2 |
| 16 | 10 | 650 | 1 |
| 20 | 10 | 0 | >1 |

Tests were also conducted in air using the identical apparatus but with negative polarity high dc voltage with respect to signal ground applied to both the tube and needle. The results are shown in Table II.

TABLE II

| TUBE −DC KV | NEEDLE +DC KV | Velocity ft./min | Spacing inches |
|---|---|---|---|
| 8 | 2 | 50 | 0 |
| 12 | 2 | 70 | 0 |
| 16 | 2 | 100 | 1/8 |
| 20 | 2 | 0 | — |
| 8 | 4 | 50 | 1/16 |
| 12 | 4 | 0 | — |
| 16 | 4 | 0 | — |
| 20 | 4 | 0 | — |
| 8 | 6 | 0 | Any |
| 12 | 6 | 50 | 0 |
| 16 | 6 | 75 | 3/8 |
| 20 | 6 | 100 | 13/16 |
| 8 | 8 | 0 | Any |
| 12 | 8 | 50 | 1/8 |
| 16 | 8 | 100 | 1/4 |
| 20 | 8 | 200 | 1/2 |
| 8 | 10 | 0 | Any |
| 12 | 10 | 0 | Any |
| 16 | 10 | 75 | 1/16 |
| 20 | 10 | 150 | 5/16 |

Tests were conducted in air with the same apparatus but applying positive dc voltage to the tube and negative dc voltage to the needle produced the results shown in Table III.

TABLE III

| TUBE +DC KV | NEEDLE −DC KV | Velocity ft./min | Spacing inches |
|---|---|---|---|
| 8 | 0 | 350 | 0 |
| 12 | 0 | 600 | 0 |
| 16 | 0 | 850 | 3/16 |
| 20 | 0 | 850 | 3/8 |
| 8 | 2 | 400 | 5/16 |
| 12 | 2 | 600 | 7/16 |
| 16 | 2 | 750 | 1/2 |
| 20 | 2 | 850 | 1/2 |
| 8 | 4 | 500 | 5/16 |
| 12 | 4 | 750 | 3/8 |
| 16 | 4 | 850 | 3/8 |
| 19 | 4# | 500 | 3/4 |
| 8 | 6 | 600 | 3/16 |
| 12 | 6# | 850 | 5/16 |
| 16 | 6# | 900 | 5/8 |
| 19 | 6# | 750 | can't set |
| 8 | 8# | 600 | 5/16 |
| 12 | 8# | 900 | 3/8 |
| 16 | 8# | 750 | can't set |
| — | —# | — | |
| 8 | 10# | 700 | 3/8 |
| 12 | 10# | 800 | 1/2 |
| 16 | 10# | 500 | can't set |
| — | —# | | |

# = Excessive electrical interaction between electrodes such that setting spacing was difficult.

Tests in air with the same apparatus were also made with positive polarity high dc voltages applied to both the tube and needle. The results are shown in Table IV.

TABLE IV

| TUBE +DC KV | NEEDLE +DC KV | Velocity Ft./Min | Spacing Inches |
|---|---|---|---|
| 8 | 2 | 75 | 7/16 |
| 12 | 2 | 100 | 7/8 |
| 16 | 2 | 120 | 1-1/16 |
| 20 | 2 | 120 | 1-1/16 |
| 8 | 4 | 70 | 0 |
| 12 | 4 | 100 | 9/16 |
| 16 | 4 | 120 | 13/16 |
| 20 | 4 | 120 | 1-1/16 |

TABLE IV-continued

| TUBE +DC KV | NEEDLE +DC KV | Velocity Ft./Min | Spacing Inches |
|---|---|---|---|
| 8 | 6 | 0 | 0 |
| 12 | 6 | 70 | 5/16 |
| 16 | 6 | 120 | 5/8 |
| 20 | 6 | 120 | 15/16 |
| 8 | 8 | 0 | 0 |
| 12 | 8 | 60 | 0 |
| 16 | 8 | 100 | 3/8 |
| 20 | 8 | 120 | 11/16 |
| 8 | 10 | 0 | 0 |
| 12 | 10 | 0 | 0 |
| 16 | 10 | 60 | 0 |
| 20 | 10 | 90 | 3/8 |

From the velocities of the ion jet streams generated, as shown by Tables I and III, it is clear that they may be employed as a propulsive force. For example, the ion jet stream may be directed against a rotary mechanism such as an impeller to produce torque. Also, the ion beam motor may be used to propel objects to which the ion beam motor is mounted.

Figure 5:
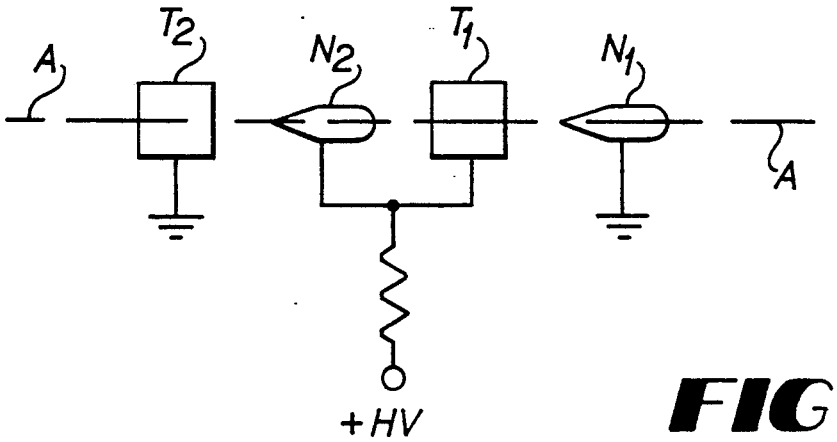
FIG. 5 is a schematic diagram of an ion beam motor embodying principles of the invention in yet another form.

For higher jet stream velocities multiple sets of pointed and tubular electrodes may be mounted in series as shown in FIG. 5. Here, a pointed electrode $N_1$ is mounted adjacent an inlet end of a tubular electrode $T_1$, as before. However, here a second pointed electrode $N_2$ is mounted adjacent the outlet of tubular electrode $T_1$ within the jet stream generated by the $T_1$ and $N_1$ motor. A second tubular electrode $T_2$ is mounted adjacent the point of the second pointed electrode $N_2$ to receive the jet stream flowing out of the tubular electrode $T_1$. Tests have shown that for the same potential difference applied between $T_2$ and $N_2$, as is applied between $T_1$ and $N_2$, air velocity was increased from 800 feet per minute for the single set of $T_1$ and $N_1$ to 1,200 feet per minute for the two set combination. By placing $N_1$ and $T_2$ both at signal ground, motor safety may be enhanced by diminishing exposure of high voltages to ambience. Also, though $N_2$ and $T_1$ have been schematically shown as discrete elements, they may, of course, be structurally combined.

On a small, laboratory scale the ions emitted from about the pointed electrode has been observed to alter the profile of small flames and to extinguish them without the use of the collimating tube. However, since the velocities are so much enhanced with the collimating tube, it is believed that such should be used for most commercial and industrial applications. Although it has been confirmed by tests that the jet stream is ionized, the degree of and duration of the ionization of the air in the jet stream has not yet been determined. It has however been found that the polarity of the charge of the ions reverses between tube inlet and outlet, i.e. the polarity of the ions in the jet stream is opposite to the polarity of the ions in the ion beam emitted from the pointed electrode.

The laser-like, collimated, ion beam emanating from the pointed electrode has been found not to be effected by steady state magnetic fields of up to 8,000 gauss. The disc shaped energy field will, however, fluctuate and waver if blown on gently. It is believed that the ion beam upon entering the tubular electrode creates a whirlpool of ionized air and that the wavering ion beam inside of the tubular electrode is along the inside walls of that whirlpool.

It thus is seen that a method has now been discovered and apparatus devised for generating ion beams and ion jet streams that may be employed as motive and as propulsive forces. Though the preferred forms of practicing the inventive concepts have been shown and described, it is clear that innumerable modifications and enhancements may, and no doubt will, be made thereto without departure from the spirit and scope of the invention as set forth in the following claims.

What is claimed is:

1. An ion beam and jet stream motor comprising, in combination, a pointed electrode having a point, a substantially tubular electrode having an inlet mounted adjacent said pointed electrode in a nonflammable gaseous medium, and means for applying high voltage between said pointed electrode and said tubular electrode, and wherein said point of said pointed electrode is mounted at a distance from said tubular electrode sufficient to prevent arcing therebetween and at a distance from said tubular electrode inlet sufficient to generate a generally disc-shaped luminous energy field adjacent said tube inlet for the magnitude of the high voltage applied.

2. The ion beam and jet stream motor of claim 1 wherein said pointed electrode comprises an elongated electrode having a pointed tip.

3. The ion beam and jet stream motor of claim 1 wherein said pointed electrode has a point mounted adjacent one end of said tubular electrode.

4. The ion beam and jet stream motor of claim 3 wherein said pointed electrode point is mounted outside of said tubular electrode.

5. The ion beam and jet stream motor of claim 1 wherein said tubular electrode has a substantially cylindrical bore.

6. The ion beam and jet stream motor of claim 1 wherein said tubular electrode has a cylindrical bore with a bore axis and said pointed electrode has a point mounted on or closely adjacent to said tubular electrode bore axis.

7. The ion beam and jet stream motor of claim 1 wherein said tubular electrode comprises a stack of juxtaposed, electrically connected rings mounted in a tubular array.

8. The ion beam and jet stream motor of claim 1 wherein said tubular electrode and said pointed electrode are in air.

9. The ion beam and jet stream motor of claim 8 wherein said high voltage applying means comprises means for establishing high voltage on said tubular electrode with respect to signal ground.

10. The ion beam and jet stream motor of claim 8 wherein said high voltage applying means comprises means for establishing high voltage on said pointed electrode with respect to signal ground.

11. The ion beam and jet stream motor of claim 10 wherein said high voltage applying means comprises means for establishing high voltage on said tubular electrode with respect to signal ground of the opposite polarity as that of the high voltage applied to said pointed electrode.

12. The ion beam and jet stream motor of claim 1 wherein said tubular electrode has an inlet and an outlet with said inlet located proximally to said pointed electrode and said outlet located proximally to said pointed electrode, and wherein said motor further comprises a second tubular electrode mounted spaced from and positioned to receive a jet stream from said tubular electrode and a second pointed electrode mounted between said tubular electrode outlet and said second tubular electrode, and means for applying high voltage between said second pointed electrode and said second tubular electrode.

* * * * *